US007889090B2

(12) United States Patent
Okuyama et al.

(10) Patent No.: US 7,889,090 B2
(45) Date of Patent: Feb. 15, 2011

(54) SEWING MACHINE AND COMPUTER READABLE MEDIUM

(75) Inventors: Tsuneo Okuyama, Inabe-gun (JP); Motoshi Kishi, Nagoya (JP); Hirokazu Hirose, Chiryu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 332 days.

(21) Appl. No.: 12/289,741

(22) Filed: Nov. 3, 2008

(65) Prior Publication Data

US 2009/0128350 A1 May 21, 2009

(30) Foreign Application Priority Data

Nov. 19, 2007 (JP) ..... 2007-299630

(51) Int. Cl.
*G08B 21/00* (2006.01)

(52) U.S. Cl. ..... 340/679; 340/680; 112/272; 112/475.02

(58) Field of Classification Search ..... 340/679, 340/680, 457; 112/275, 277, 475.02, 182, 112/190, 272
See application file for complete search history.

(56) References Cited

U.S. PATENT DOCUMENTS 4,104,976 A * 8/1978 Landau et al. ..... 112/470.02
4,915,045 A 4/1990 Fujikawa et al.
5,839,382 A * 11/1998 Tice et al. ..... 112/470.04

FOREIGN PATENT DOCUMENTS

| | | |
|---|---|---|
| JP | A-62-57584 | 3/1987 |
| JP | A-64-37989 | 2/1989 |
| JP | A-11-290563 | 10/1999 |
| JP | A-2000-279677 | 10/2000 |
| JP | A-2002-248283 | 9/2002 |
| JP | A-2005-110732 | 4/2005 |
| JP | A-2006-263268 | 10/2006 |

* cited by examiner

*Primary Examiner*—Toan N Pham
(74) *Attorney, Agent, or Firm*—Oliff & Berridge, PLC

(57) ABSTRACT

A sewing machine including a maintenance information storage that stores maintenance information; an alert element that communicates maintenance information; a cumulative data storage that stores cumulative data of at least either of a sew time or a stitch count; a determiner that determines whether or not a predetermined timing for communicating the maintenance information has been reached based on the cumulative data; an alert count storage that stores an alert count of the maintenance information communicated; and an alert controller that, when determined by the determiner to have reached the predetermined timing for communicating the maintenance information, controls the alert element to communicate the maintenance information for a predetermined number of times based on the alert count.

12 Claims, 9 Drawing Sheets

| | SEW TIME | STITCH COUNT | | | MEMORY |
|---|---|---|---|---|---|
| | | TOTAL | EMBROIDERY SEWING | UTILITY SEWING | |
| CUMULATIVE DATA | Ta | Na | Na1 | Na2 | EEPROM |
| WHEN POWER TURNED OFF | Tb | Nb | Nb1 | Nb2 | EEPROM |
| WHEN POWER TURNED ON | Tc | Nc | Nc1 | Nc2 | RAM |

FIG.3

| MAINTENANCE INFORMATION TYPE | EXAMPLE OF MAINTENANCE INFORMATION |
|---|---|
| SEW TIME | SEW TIME EXCEEDED 500 HOURS MAINTENANCE REQUIRED |
| EMBROIDERY STITCH COUNT | EMBROIDERY STITCH COUNT EXCEEDED 6 MILLION STITCHES MAINTENANCE REQUIRED |
| UTILITY STITCH COUNT | UTILITY STITCH COUNT EXCEEDED 3 MILLION STITCHES MAINTENANCE REQUIRED |
| TOTAL STITCH COUNT | TOTAL STITCH COUNT EXCEEDED 9 MILLION STITCHES MAINTENANCE REQUIRED |
| ABNORMALITY FOUND IN RELATION BETWEEN SEW TIME AND STITCH COUNT | PROBLEM IN USAGE TOO MUCH HIGH-SPEED SEWING |

FIG. 7

SEWING MACHINE AND COMPUTER READABLE MEDIUM

CROSS-REFERENCE TO RELATED APPLICATIONS

This application is based upon and claims the benefit of priority from the prior Japanese Patent Application 2007-299630, filed on Nov. 19, 2007, the entire contents of which are incorporated herein by reference.

FIELD

The present disclosure relates to a sewing machine that communicates a maintenance information alert when reaching a predetermined timing determined by monitoring the operational status of the sewing machine. The present disclosure also relates to a computer readable medium storing a maintenance information alert program.

BACKGROUND

Conventional sewing machines have been provided with alerting devices that allow displaying of alert messages for prompting a user to refill or replace lubricant when cumulative sew time has exceeded a predetermined time period. One of such example is disclosed in JP 2006-263268 A (hereinafter referred to as reference 1). Reference 1, discloses a maintenance timing alerter that stores reference maintenance information. The reference maintenance information provides exemplary standard maintenance timing under exemplary standard load to provide a reference to the user as to when lubricant should be supplied to mechanical elements such as sliding engagement elements of a sewing machine operated under the exemplary standard load. The maintenance timing alerter monitors the actual load or conditions under which the sewing machine is being operated and corrects the standard maintenance timing based on the actual load to obtain a modified maintenance timing. Then, the maintenance timing alerter issues a warning to prompt lubricant refill to the user whenever cumulative sew time reaches the modified maintenance timing.

However, since the warning is only displayed once, the user may not notice the alert and allow the lubricant to run out, which in turn may cause seizures at the mechanical elements of the sewing machine such as the sliding engagement elements.

SUMMARY

An object of the present disclosure is to provide a sewing machine that reliably communicates maintenance information alert to the user to prevent oversight of the maintenance information. Another object of the present disclosure is to provide a computer readable medium that stores maintenance information alert program for implementing the above described features.

In one aspect, the present disclosure discloses a sewing machine including a maintenance information storage that stores maintenance information; an alert element that communicates the maintenance information; a cumulative data storage that stores cumulative data of at least either of a sew time or a stitch count; a determiner that determines whether or not a predetermined timing for communicating the maintenance information has been reached based on the cumulative data; an alert count storage that stores an alert count of the maintenance information communicated; and an alert controller that, when determined by the determiner to have reached the predetermined timing for communicating the maintenance information, controls the alert element to communicate the maintenance information for a predetermined number of times based on the alert count.

The cumulative data storage stores cumulative data of at least either of the sew time or the stitch count every time a sewing operation is executed by the sewing machine. The determiner determines whether or not the timing has been reached for communicating the maintenance information based on the cumulative data. The alert count storage stores the count of the maintenance information communicated. The alert controller communicates the maintenance information based on the result of determination by the determiner and the alert count stored in the alert count storage.

The above described configuration allows the maintenance information to be communicated for a predetermined multiple number of times based on the alert count stored in the alert count storage. Thus, the maintenance information alert can be communicated with greater reliability and prevent oversight of the maintenance information by the user.

In another aspect, a computer readable medium storing a maintenance information communicating program for use in a sewing machine including a maintenance information storage that stores maintenance information, an alert element that communicates the maintenance information, a cumulative data storage that stores cumulative data of at least either of a sew time or a stitch count, an alert count storage that stores an alert count of the maintenance information communicated, the computer readable medium storing the maintenance information alert program, including instructions for storing the cumulative data to the cumulative data storage; instructions for determining whether or not a predetermined timing for communicating the maintenance information has been reached based on the cumulative data; instructions for storing the alert count of the maintenance information communicated to the alert count storage; and instructions for communicating the maintenance information for a predetermined number of times based on the alert count when determined to have reached the predetermined timing for communicating the maintenance information.

The above described configuration also provides the effect provided by the sewing machine by reading and executing the maintenance information alert program stored in the computer readable medium with the controller which controls the sewing machine.

BRIEF DESCRIPTION OF THE DRAWINGS

Other objects, features and advantages of the present disclosure will become clear upon reviewing the following description of the illustrative aspects with reference to the accompanying drawings, in which.

FIG. 3 is a chart describing cumulative data of sew time and stitch count;

FIG. 7 shows an exemplary maintenance information;

DETAILED DESCRIPTION

Figure 1:
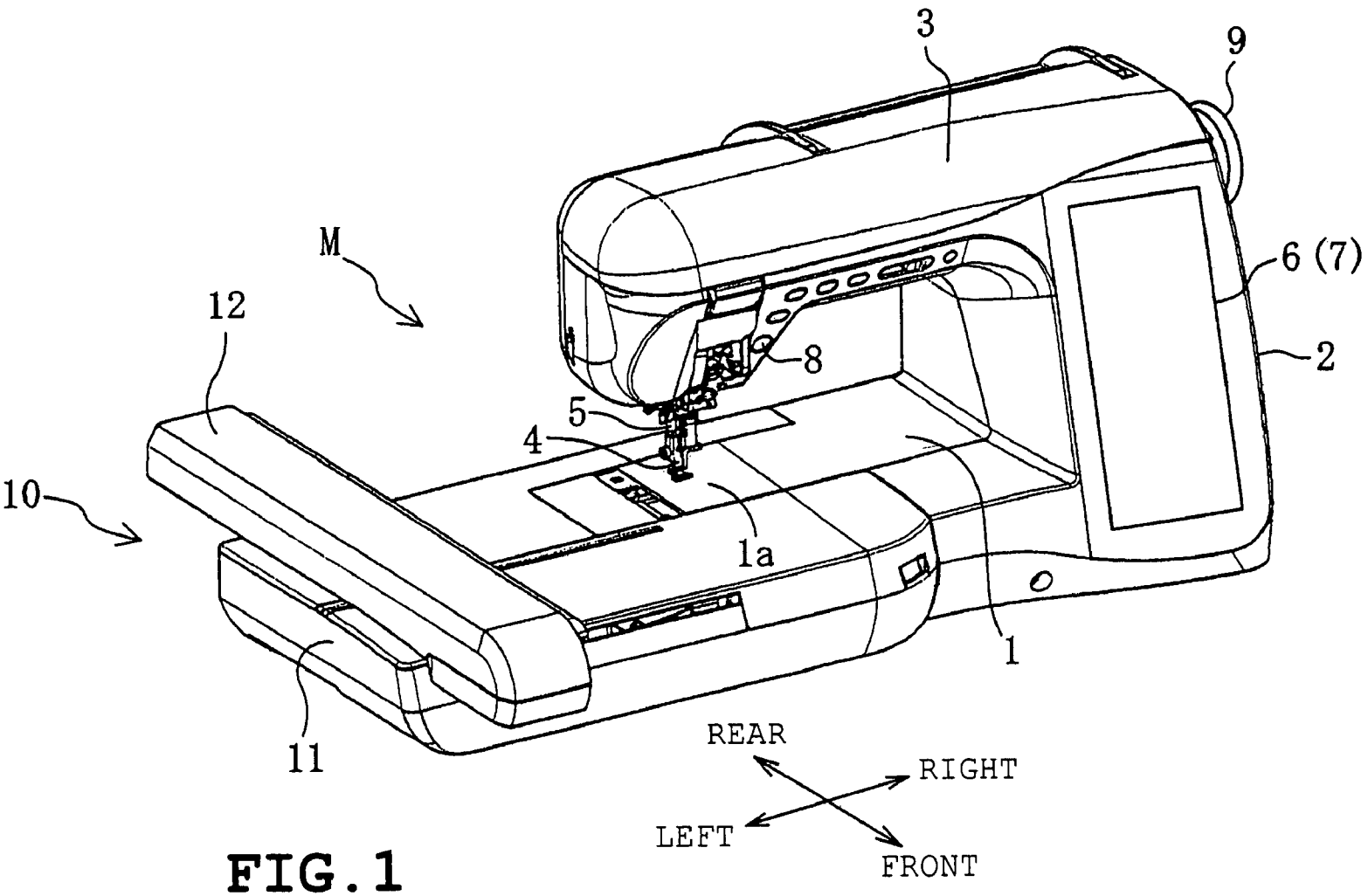
FIG. 1 is a perspective view of a sewing machine according to one exemplary embodiment of the present disclosure.

Referring to FIG. 1, an embroiderable sewing machine M according to one exemplary embodiment of the present disclosure includes a bed 1, a pillar 2 standing on the right end of bed 1, and an arm 3 extending leftward over bed 1 from the upper end of pillar 2. Bed 1 has a needle plate 1*a* provided on its upper surface. Provided in the bed 1 interior below needle plate 1*a* are components such as a feed dog vertically moving mechanism (not shown) for vertically moving a feed dog (not shown); a feed dog longitudinally moving mechanism (not shown) for longitudinally moving the feed dog; and a shuttle mechanism (not shown) having a bobbin thread bobbin (not shown) attachably/detachably attached to it.

Bed 1 has a free arm portion provided in the proximity of needle plate 1*a* that allows attachable/detachable attachment of an embroidery unit 10. Embroidery unit 10 forms embroidery patterns by utilizing an embroidery frame (not shown) that holds a workpiece cloth (not shown) in a stretched manner. Embroidery unit 10 comprises a body case 11, and a carriage 12. Body case 11 contains an X-directional transfer mechanism (not shown) and an X-directional drive motor 26 shown in FIG. 2 that transfer the embroidery frame in the X-direction (lateral direction). Carriage 12 contains a Y-directional transfer mechanism and a Y-directional drive motor 27 that transfer the embroidery frame in the Y-direction (longitudinal direction). On the front face of pillar 2, a color liquid crystal display (hereinafter referred to as LCD) 6 is provided for displaying a menu screen, a pattern selection screen, images of embroidery patterns, and other items.

On the front face of LCD 6, a touch panel 7 comprising matrix-aligned touch keys composed of transparent electrodes is provided for user operation. The user is allowed to select the desired pattern to be sewn and functions to be executed by finger tip depression of touch keys displayed on LCD 6 representing the patterns and functions. The types of patterns selectable from LCD 6 are utility patterns comprising straight and/or zigzag stitches formed by transferring a workpiece cloth with a feed dog, and embroidery patterns formed by transferring the workpiece cloth with an embroidery frame attached to embroidery unit 10.

Figure 2:
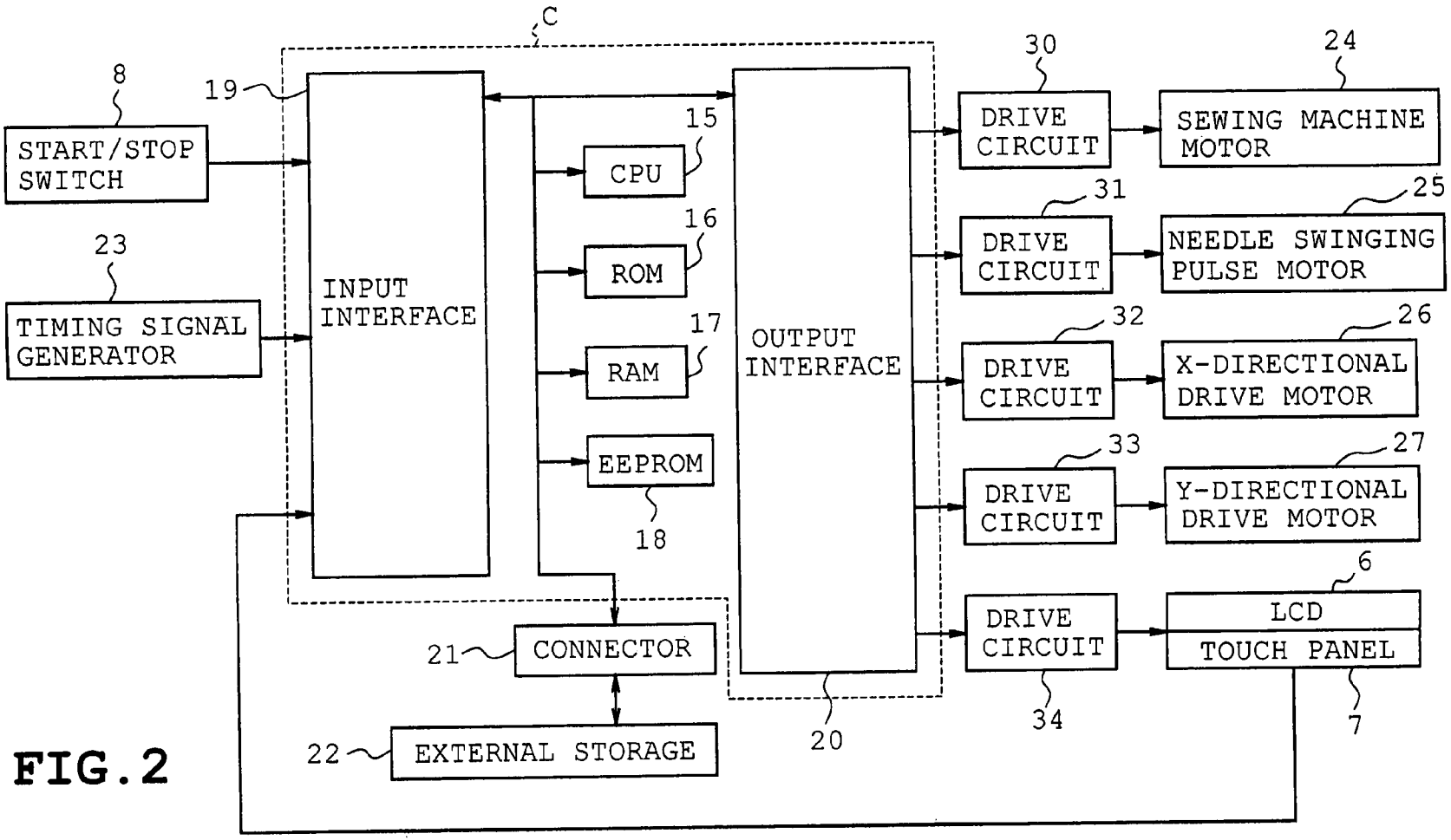
FIG. 2 is a block diagram of a control system of the sewing machine.

Arm 3 includes components such as a laterally extending main shaft (not shown) rotated by a sewing machine motor 24 shown in FIG. 2, a hand pulley 9 allowing manual rotation of the main shaft, a needle bar drive mechanism (not shown) that vertically moves a needle bar 5 having a sewing needle 4 attached to its lower end, a needle bar swinging mechanism (not shown) that swings needle bar 5 in a direction orthogonal to the cloth feed direction (longitudinal direction), and a thread take-up drive mechanism (not shown) including a thread take-up (not shown). On the front side of arm 3, various types of switches such as a start/stop switch 8 for instructing start/stop of a sewing operation is provided.

Next, a description will be given on a control system of embroiderable sewing machine M.

Referring to FIG. 2, a controller C is configured by a microcomputer comprising a CPU 15, a ROM 16, a RAM 17, and a nonvolatile programmable EEPROM 18, an input interface 19 and an output interface 20, which are connected to the microcomputer by elements such as a data bus.

Input interface 19 establishes electrical connection with components such as start/stop switch 8, a timing signal generator 23 for detecting the rotational position of the main shaft, and touch panel 7. Output interface 20 establishes electrical connections with components such as sewing machine motor 24, a needle swinging pulse motor 25 for driving the needle bar swinging mechanism that laterally swings needle bar 5, X-directional drive motor 26 that drives the X-directional drive mechanism for transferring the embroidery frame in the X direction, Y-directional drive motor 27 for driving the Y-directional drive mechanism for transferring the embroidery frame in the Y direction, LCD 6, and touch panel 9 through drive circuits 30, 31, 32, 33, and 34, respectively. External storage such as CD-ROM drive may be connected to connector 21.

ROM 16 pre-stores control programs such as a control program for sewing utility patterns, a control program for sewing embroidery patterns based on embroidery data, a display control program for displaying various types of information on LCD 6, a pattern selection control program for selecting a given pattern from the patterns displayed on LCD 6, and a maintenance information alert program for communicating a later described maintenance information alert program.

EEPROM 18 includes a data memory that pre-stores sewing data for multiple patterns, and various work memory. When executing a sewing operation with sewing machine M, controller C reads the sewing data of the selected pattern from EEPROM 18 and stores it in the data memory of RAM 17. RAM 17 includes a data memory for storing the sewing data of the pattern to be sewn read from EEPROM 18 and various work memory.

Next, a description will be given on various types of cumulative data used in the maintenance information alert program executed for communicating the later described maintenance information based on FIG. 3. Cumulative data is configured by sew time and stitch count, and stitch count as generally understood in the field indicates the count of stitches formed, or in other words, count of vertical reciprocation of sewing needle 4.

Sew time Ta indicates cumulative or total sew time tracked from the user's first use of sewing machine M and is updated whenever power is turned on. Stitch count Na indicates cumulative count of stitches tracked from the user's first use of sewing machine M and is also updated whenever power is turned on. Stitch count Na is the sum of cumulative stitch count Na1 consumed in sewing embroidery patterns and cumulative stitch count Na2 consumed in sewing utility patterns and are also updated whenever power is turned on. Sew time Ta and stitch counts Na, Na1, and Na2 are stored in EEPROM 18 as a first cumulative data.

Sew time Tb indicates cumulative sew time updated whenever power of the sewing machine is turned off. Stitch count Nb is cumulative stitch count updated whenever power of the sewing machine is turned off. Stitch count Nb is the sum of cumulative stitch count Nb1 consumed in sewing embroidery patterns and cumulative stitch count Nb2 consumed in sewing utility patterns and are also updated whenever power is turned off. Sew time Tb and stitch counts Nb, Nb1, and Nb2 are stored in EEPROM 18 as a second cumulative data.

Sew time Tc indicates cumulative sew time tracked during the current sewing operation lasting from the latest switch on to the latest switch off; in other words, the cumulative sew time consumed while power is on. Similarly, stitch count Nc is cumulative stitch count tracked in the current sewing operation lasting from the latest switch on to the latest switch off and is the sum of Nc1 and Nc2. Sew time Tc, stitch counts Nc, Nc1 and Nc2 are stored in the data memory of RAM 17.

Next, a description will be given on a maintenance information alert control executed by controller C with reference to flowcharts indicated in FIGS. 4 to 6. Reference symbols Si (i=1, 2, . . . ) indicate each step of the control flow.

Control C starts the control when power of sewing machine M is turned on. As the first step of the control, update process is executed (step S1) for updating sew time Ta, stitch counts Na, Na1, and Na2. The update process will be detailed with reference to FIG. 5.

Figure 5:
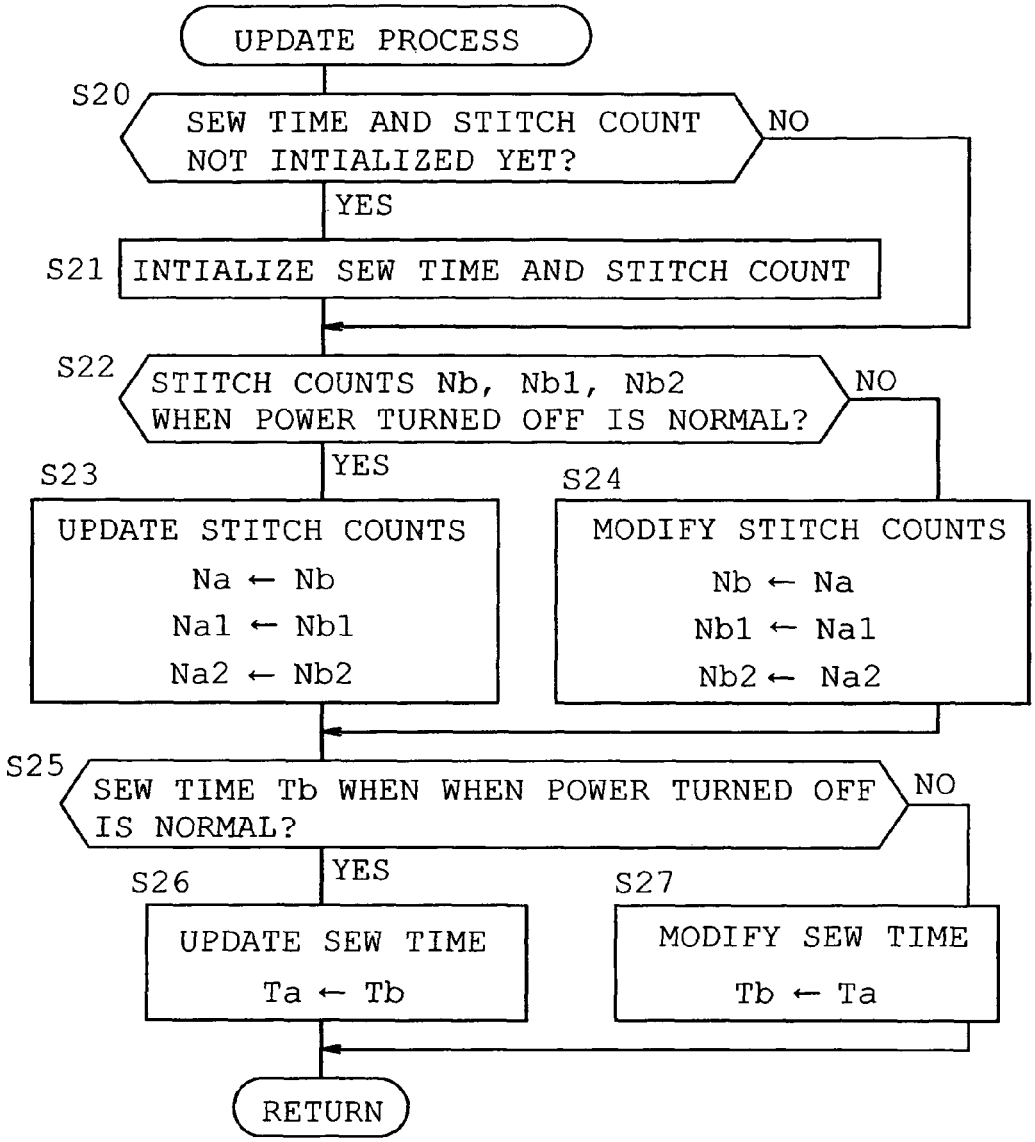
FIG. 5 is a flowchart of an update process for updating the cumulative data of sew time and stitch count, respectively.

As can be seen in FIG. 5, at step S20, controller C determines whether or not sew time and stitch count have yet to be initialized. If not initialized yet, (step S20: Yes), controller C proceeds to step S21 and initializes sew time and stitch count. At this instance, sew time Ta and stitch counts Na, Na1, and Na2, are initialized to preset values respectively.

Initialization is normally done at factory shipment. Maintenance information alert program may be downloaded from sources such as a web server through data communication lines to sewing machine M after shipment. In such case, sew time and stitch count are initialized when executing the maintenance information alert program for the first time after it has been read by sewing machine M. Further, controller C of sewing machine M in user's possession may be configured to store only cumulative stitch count. In such case, controller C may convert 5 stitches into 1 second of sew time during initialization and consider the converted value as the initial value of sew time. Controller C, after initialization, flags an initialization flag and stores it in a work memory of EEPROM 18.

If sew time and stitch count have been initialized (step S20: No), or initialized at S21, controller C proceeds to step S22 and determines whether or not cumulative stitch counts Nb, Nb1, and Nb2 are normal.

More specifically, controller C compares stitch counts Nb with Na, Nb1 with Na1, and Nb2 with Nb2, respectively. If Nb, Nb1, and Nb2 are less than the corresponding Na, Na1, and Na2, controller C makes a determination that stitch counts Nb, Nb1, and Nb2 are abnormal (step S22:No) and proceeds to S24. In case stitch counts Nb, Nb1, and Nb2 exceed the reasonably expected magnitude under normal usage (for example, when stitch counts Nb, Nb1, and Nb2 exceed the stitch count when sewing machine M is operated continuously for a week, that is, 24 hours non-stop for seven days), controller C makes a determination that stitch counts Nb, Nb1, and Nb2 are abnormal (step S22: No) and proceeds to step S24. Otherwise, controller C makes a determination that stitch counts Nb, Nb1, and Nb2 are normal (step S22: Yes) and proceeds to step S23.

At step S23, since stitch counts Nb, Nb1, and Nb2 are normal, controller C updates stitch counts Na, Na1, and Na2 to stitch counts Nb, Nb1, and Nb2 respectively. At step S24, since stitch counts Nb, Nb1, and Nb2 are abnormal, controller C overwrites stitch counts Nb, Nb1, and Nb2 with stitch counts Na, Na1, and Na2 stored in EEEPROM 18. In other words, controller C modifies stitch counts Nb, Nb1, and Nb2 to stitch counts Na, Na1, and Na2, respectively.

Then, at subsequent step S25, controller C determines whether or not sew time Tb is normal. More specifically controller C compares sew time Tb with sew time Ta. If sew time Tb is less than sew time Ta, controller C makes a determination that sew time Tb is abnormal (step S25: No) and proceeds to S27. In case sew time Tb exceeds the reasonably expected magnitude under normal usage (for example, when sew time Tb exceeds sew time when sewing machine M is operated continuously for a week, that is, 24 hours non-stop for seven days), controller C makes a determination that sew time Tb is abnormal (step S25: No) and proceeds to step S27. Otherwise, controller C makes a determination that sew time Tb is normal (step S25: Yes) and proceeds to step S26.

At step S26, since sew time Tb is normal, controller C updates sew time Ta to sew time Tb. At step S27, since sew time Tb is abnormal, controller C overwrites sew time Tb with sew time Ta stored in EEEPROM 18. In other words, controller C modifies sew time Tb to sew time Ta. Then, controller C returns the control to step S2 indicated in FIG. 4.

At step S22, controller C clears sew time Tc and stitch counts Nc, Nc1, and Nc2 to 0 in order to track the sew time and the stitch count consumed sewing operation executed in the current duration of on time. Then, controller C executes timing determination process (step S3) in order to determine whether or not the timing has been reached to communicate maintenance information. A description will be given hereinafter on timing determination process with reference to FIG. 6.

As the first step after staring the timing determination process, controller C determines whether or not sew time Ta stored in EEPROM 18 has reached the timing to display the maintenance information (step S30). If sew time Ta has not reached the timing to display the maintenance information (step S30: No), controller C proceeds to step S31. If sew time Ta has reached the timing to display the maintenance information (step S30: Yes), controller C proceeds to step S36. The sew time at which the maintenance information is to be displayed are set in 6 timings, for example, and stored in ROM 16. In the present exemplary embodiment, maintenance information is set to be displayed when reaching 500 hours, 600 hours, 700 hours, 800 hours, 900 hours, and 1000 hours.

On the other hand, the embroidery stitch counts (refer to step S31) at which maintenance information is to be displayed are set in 4 stitch counts, for example, and stored in ROM 16. In the present exemplary embodiment, maintenance information is set to be displayed at 6 million stitches, 8 million stitches, 10 million stitches, and 12 million stitches. The utility stitch count (refer to step S32) at which maintenance information is to be displayed are likewise set in 4 stitch counts, for example, and stored in ROM 16. In the present exemplary embodiment, maintenance information is set to be displayed at 3 million stitches, 4 million stitches, 5 million stitches, and 6 million stitches. Total stitch count at which maintenance information is to be displayed are set in 4 stitch counts, for example, and stored in ROM 16. In the present exemplary embodiment, maintenance information is set to be displayed at 9 million stitches, 12 million stitches, 15 million stitches, and 18 million stitches.

At step S31, controller C determines whether or not embroidery stitch count Na1 stored in EEPROM 18 has reached the embroidery stitch count to display the maintenance information. If embroidery stitch count Na1 has not reached the embroidery stitch count to display the maintenance information (step S31: No), controller C proceeds to step S32. If embroidery stitch count Na1 has reached the embroidery stitch count to display the maintenance information (step S31: Yes), controller C proceeds to step S36.

At step S32, controller C determines whether or not utility stitch count Na2 stored in EEPROM 18 has reached the utility stitch count to display the maintenance information. If utility stitch count Na2 has not reached the utility stitch count to display the maintenance information (step S32: No), controller C proceeds to step S33. If utility stitch count Na2 has reached the utility stitch count to display the maintenance information (step S32: Yes), controller C proceeds to step S36.

At step S33, controller C determines whether or not total stitch count Na stored in EEPROM 18 has reached the total stitch count to display the maintenance information. If total stitch count Na has not reached the total stitch count to display the maintenance information (step S33: No), controller C proceeds to step S34. If total stitch count Na has reached the total stitch count to display the maintenance information (step S33: Yes), controller C proceeds to step S36.

At step S34, controller C determines whether or not the relation between sew time and stitch count are normal. More specifically, controller C calculates stitch count per unit time based on sew time and stitch count. Then, controller C compares stitch count per unit time with standard stitch count expected under normal use of the sewing machine to determine whether or not the relation between sew time and stitch count are normal. The standard stitch count is preset and stored in ROM 16. If the relation between sew time and stitch count is abnormal (step S34: No), controller C proceeds to step S35. If sew time and stitch count is normal (step S34: Yes), controller C proceeds to step S36.

Figure 4:
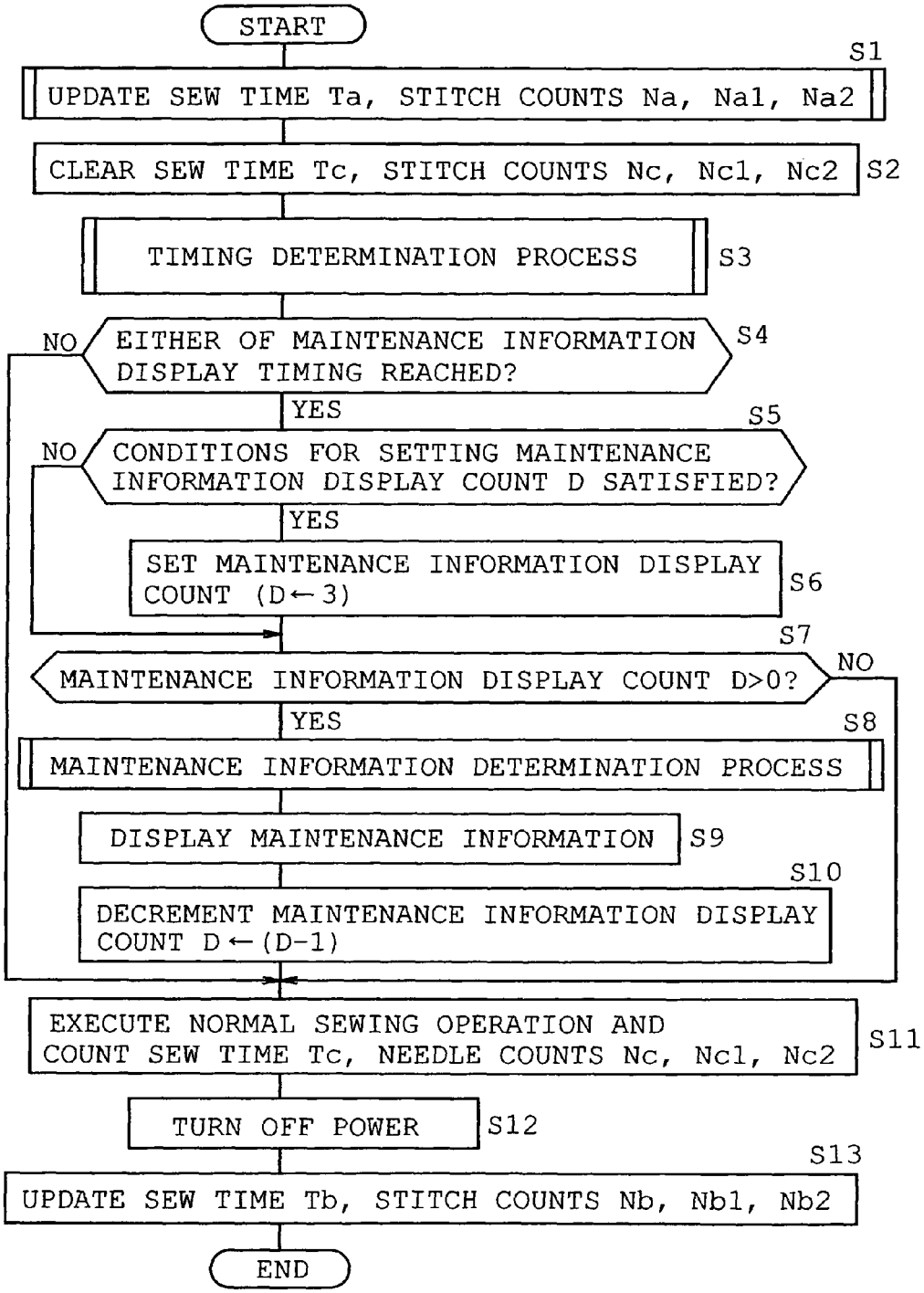
FIG. 4 is a flowchart of a maintenance information alert control.

At step S35, since alert timing to communicate the maintenance information has not been reached, controller C sets flag F to "0" and returns the control to step S4 indicated in FIG. 4. At step S36, since alert timing to communicate the maintenance information has been reached, controller C sets flag F to "1", and returns the control to step S4 of FIG. 4.

Figure 6:
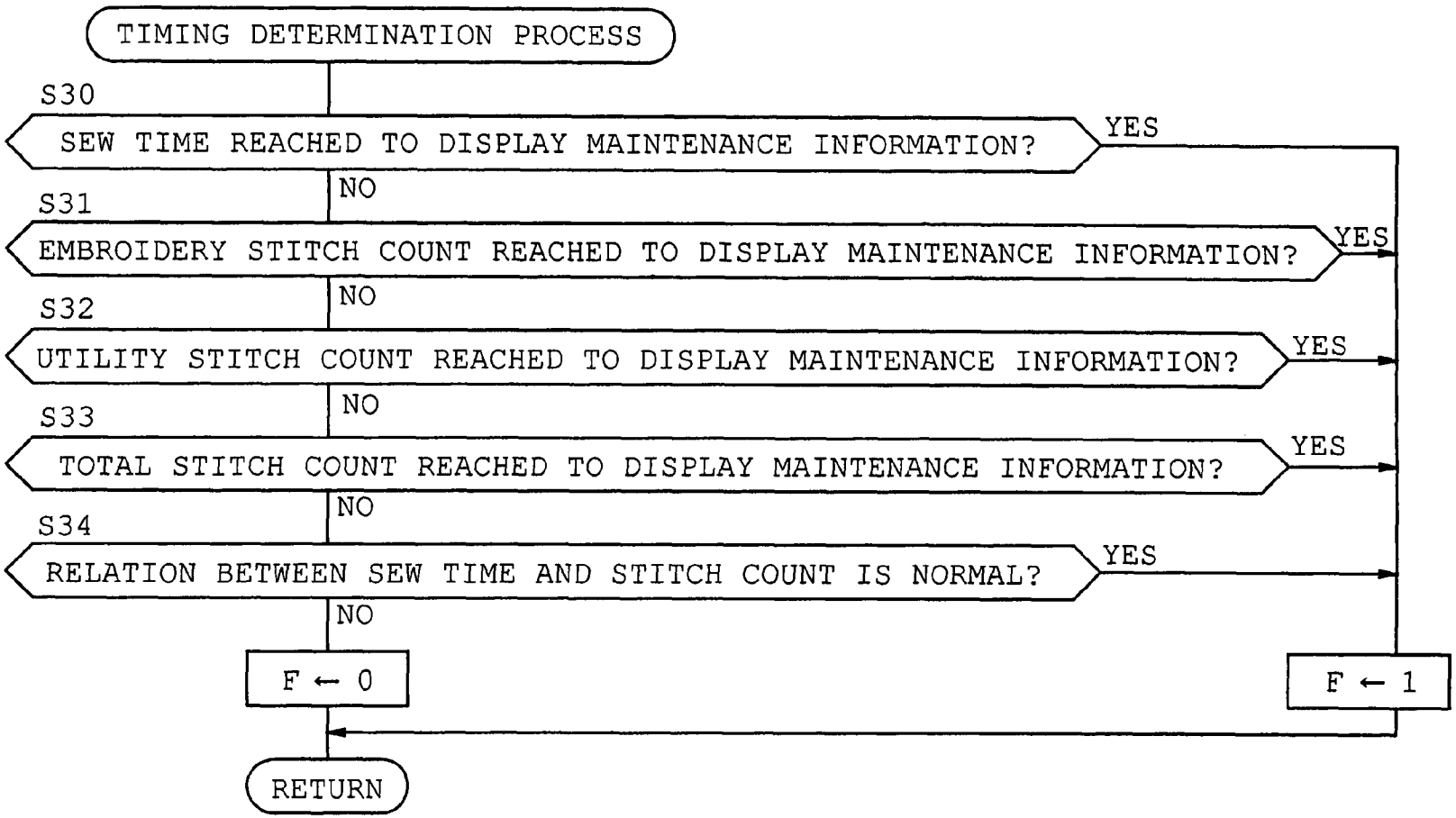
FIG. 6 is a flowchart of a timing determination control for determining the timing for displaying maintenance information.

In the above described timing determination process, 6 timings, for example, are set as timings to communicate the maintenance information in terms of sew time (refer to step S30 indicated at FIG. 6). In the present exemplary embodiment, maintenance information is set to be displayed when reaching 500 hours, 600 hours, 700 hours, 800 hours, 900 hours, and 1000 hours. When 500 hours of sew time have elapsed, controller C sets "3" to display count D (step S6 of FIG. 4). Then, after the maintenance information is displayed 3 times and display count D is reduced to "0" (step S7: No), controller C thereafter makes a "No" determination at step S30 of FIG. 6 until sew time reaches 600 hours. The maintenance information alert control program is configured to make the above described determination. The maintenance information alert control program is configured to execute similar process for embroidery stitch count (step S31), utility stitch count (step S32), and total stitch count (step S33) as well.

At step S4 indicated in FIG. 4, controller C determines whether or not any of the timings to display the maintenance information have been reached based on flag F. If any given of timing to display the maintenance information display has been reached (step S4: Yes), controller C proceeds to S5. If neither of the maintenance information display timing has been reached (step S4: No), controller C proceeds to step S11 (refer to FIG. 4). At step S5, controller C determines whether or not conditions to set maintenance information display count D has been met. For example, in terms of sew time Ta, controller C assumes that the condition has been met when sew time reaches 500 hours, 600 hours, 700 hours, 800 hours, 900 hours, and 1000 hours, respectively. Otherwise, when sew time Ta is somewhere between 500 hours and 600 hours, for example, controller C makes a No decision at step S5. The above described approach of determination is pursued in embroidery stitch count Na1, utility stitch count Na2, and total stitch count Na as well.

When a "NO" decision is made at step S5, controller C proceeds to step S7. If a "Yes" decision is made at step S5, controller C sets "3", for example, to maintenance information display count D (step S6). Next, controller C determines whether or not the maintenance information display count D is greater than 0 (step S7). If the maintenance information display count D is equal to or less than 0 (step S7: No), controller C proceeds to step S11 (refer to FIG. 4). If the maintenance information display count D is greater than 0 (step S7: Yes), controller C proceeds to step S8, and executes a maintenance information determination process to determine the maintenance information to be displayed.

As can be seen in FIG. 7, ROM 16 pre-stores display data of various maintenance information. In terms of sew time Ta, display data that reads "Sew time exceeded [blank] hours. Maintenance is required" is stored. In the maintenance information determination process, when sew time Ta has reached 500 hours, for example, controller C populates the applicable time, in this case 500 hours, in the [blank] for representing sew time in display data. Controller C stores the display data populated with time to the work memory of RAM 17. Controller C executes similar process for embroidery stitch count Na1, utility stitch count Na2, and total stitch count Na. An example of the maintenance information is shown in FIG. 7. As can be seen in FIG. 7, maintenance information is information for prompting the user to take maintenance action for sewing machine M based on status of use (status which is represented, in this case, by sew time Ta, embroidery stitch count Na1, utility stitch count Na2, and total stitch count Na) and usage of sewing machine M.

Figure 8:
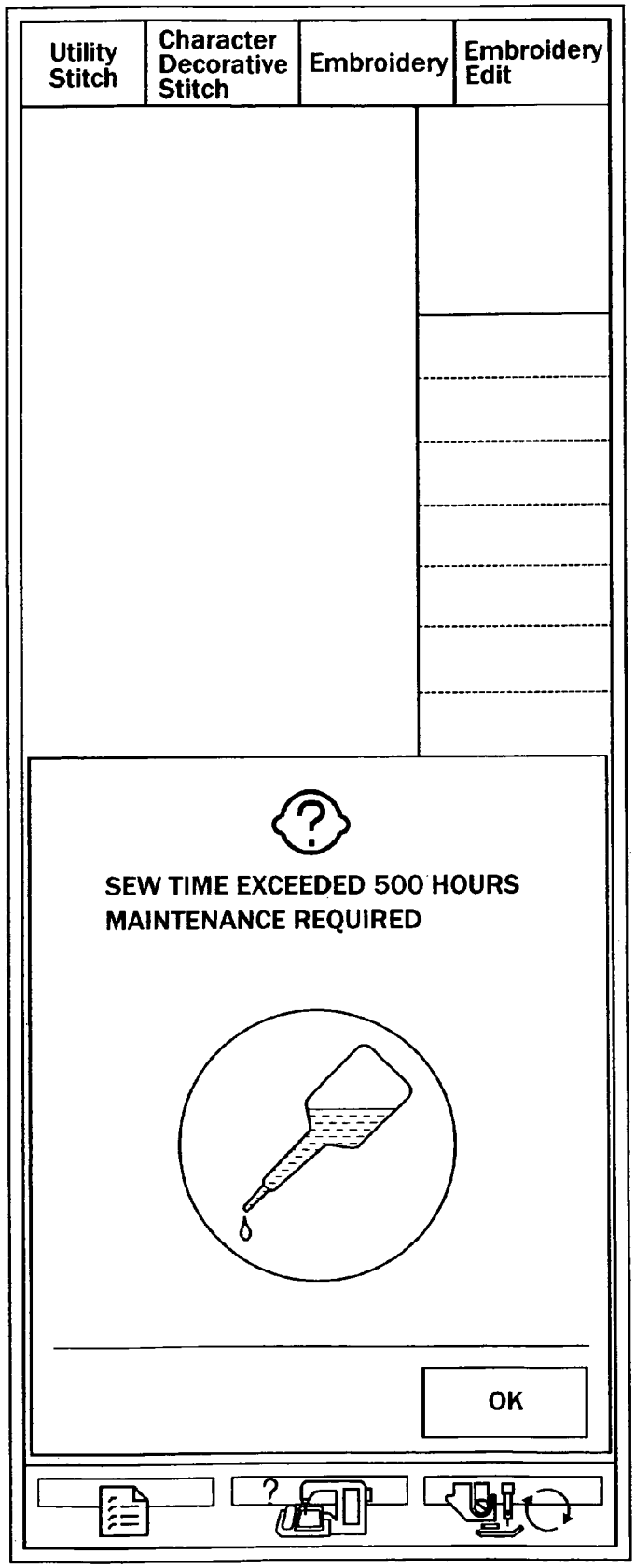
FIG. 8 is one example of the maintenance information to be displayed on a liquid crystal display.
Figure 9:
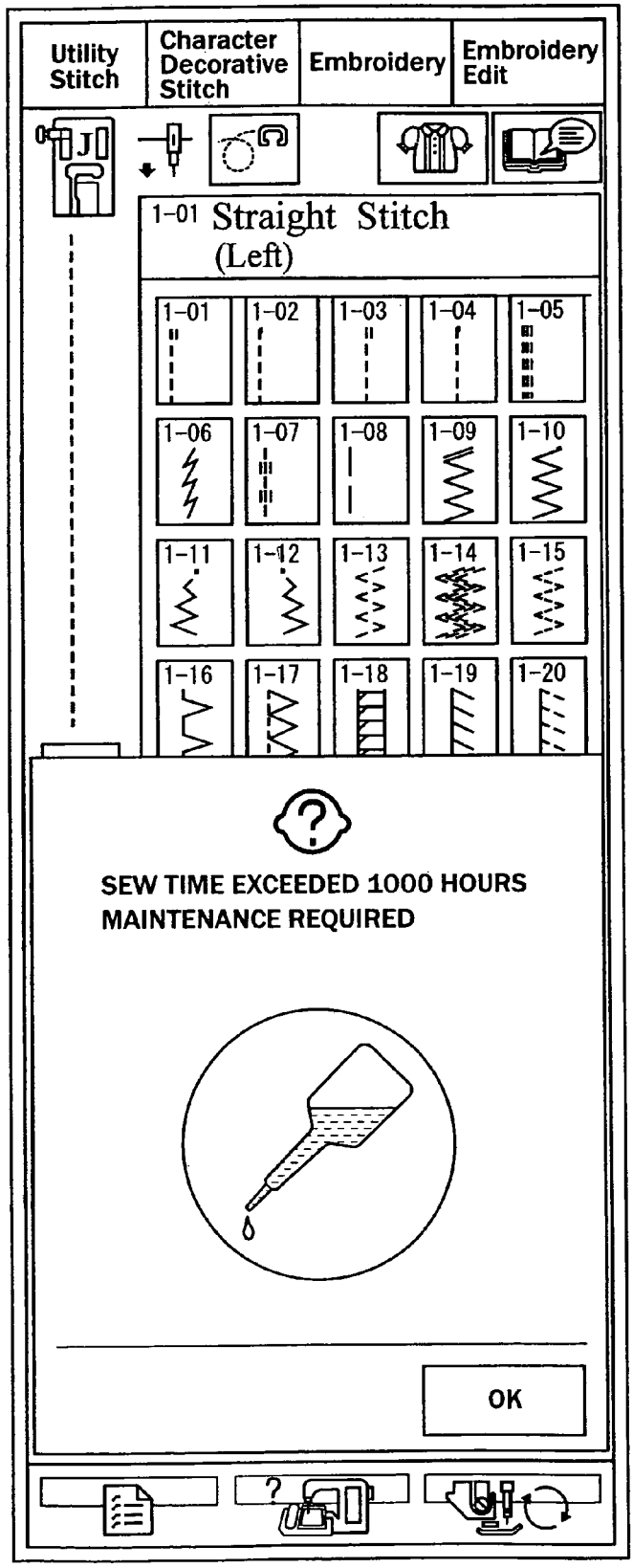
FIG. 9 is another example of the maintenance information to be displayed on the liquid crystal display.

Next, at step S9 (refer to FIG. 4), controller C displays the maintenance information determined at step S8 on LCD 6. As can be seen in FIGS. 8 and 9, the maintenance information may be represented by predetermined graphics in addition to character and numeric information. If the relation between sew time and stitch count is found to be abnormal, controller C displays the alert message exemplified in FIG. 7 that reads "Abnormal usage. Too much high-speed sewing". Next, at step S10, controller C decrements the maintenance information display count D by "1", and proceeds to step S11 indicated in FIG. 4. At step S11, controller C executes normal work (sewing operation) as well as counting and updating of sew time Tc, stitch counts Nc, Nc1 and Nc2.

When power of sewing machine M is shut down (step S12), controller C calculates and writes sew time Tb, stitch counts Nb, Nb1, and Nb2 to EEPROM 18 by utilizing a descending voltage observed in a small time span (approximately 80 ms, for example) immediately after power is shut down (step S13). In this case, calculation based on equations Tb=Tb+Tc, Nb=Nb+Nc, Nb1=Nb1+Nc1, and Nb2=Nb2+Nc2 are performed to add the consumed values in the current sewing operation to the previous cumulative values. Controller C, after updating sew time Tb and stitch counts Nb, Nb1, and Nb2 when turning off power, terminates maintenance information alert control.

When power of sewing machine M is turned on to start the subsequent iteration of sewing operation, controller C executes steps S1 to S13 as described above. Since maintenance information display count D indicates "2" (step S7: Yes), controller C displays the maintenance information (steps S8 and S9). After displaying the maintenance information 3 times, the maintenance information display count is reduced to "0", and controller C makes a "No" decision, and thus, no maintenance information is displayed.

The above described series of steps will be supplemented by exemplary description hereinafter. When sew time Ta has reached 500 hours, display for communicating maintenance information is displayed once every time power of sewing machine M is turned on for total of 3 times. Then, after sew time Ta has reached 600 hours, maintenance information alert is displayed 3 times for a total of 3 times. Thereafter, whenever sew time reaches 700 hours, 800 hours, 900 hours, and 1000 hours, respectively, maintenance information alert is similarly displayed for a total of 3 times.

A description will be given hereinafter on operation and effect of the maintenance information alert control executed by sewing machine M and controller C.

Controller C of sewing machine M manages cumulative values of sew time Tb, stitch counts Nb, Nb1, and Nb2 and cumulative values of sew time Ta, stitch counts Na, Na1, and Na2 separately. As described earlier, cumulative values of sew time Tb, stitch counts Nb, Nb1, and Nb2 are updated every time power is turned off and stored in a dedicated storage area; whereas cumulative values of sew time Ta, stitch counts Na, Na1, and Na2 are updated by using the cumulative values of sew time Tb, stitch counts Nb, Nb1, and Nb2 and are stored in a dedicated storage area.

Then, controller C compares one of the cumulative data group (sew time Ta, stitch count Na, Na1, and Na2) with the other cumulative data group (sew time Tb, stitch count Nb, Nb1, and Nb2) and verifies their normality/abnormality. If either of the cumulative data group is abnormal, controller C may utilize the remaining normal cumulative data group to modify the abnormal cumulative data group.

The above described configuration improves the reliability of the cumulative values given for sew time Tb, stitch counts Nb, Nb1, and Nb2, and for sew time Ta, stitch counts Na, Na1, and Na2 to communicate the maintenance information in more accurate timings. The maintenance information can thus, be reliably communicated at the timing most required by sewing machine M requires maintenance. Especially because the maintenance information is communicated each time power of sewing machine M is turned on for a total of three times, the maintenance information can be reliably communicated and recognized by the user.

In the event that either of the first or the second cumulative data is abnormal, the remaining other group of cumulative data will serve as backup to improve the reliability of the first and the second cumulative data.

In the above described configuration in which the small time span (approximately 80 ms, for example) immediately after power is turned off is utilized to update the cumulative value, the update may fail by factors such as lack of voltage, resulting in storing of abnormal values. The present exemplary embodiment compares the first cumulative data (sew time Ta, stitch counts Na, Na1, and Na2) updated when power is turned on with the second cumulative data (sew time Tb, stitch counts Nb, Nb1, and Nb2) which are updated when power is turned OFF. Thus any abnormality occurring in either of the cumulative data group can be readily detected.

By updating the first cumulative data and the second cumulative data at different timings and storing them separately, the first and the second cumulative data can be managed with greater reliability, consequently allowing the maintenance information to be communicated with greater accuracy.

Controller C stores the cumulative value of stitch count Na in two separate categories namely, embroidery stitch count Na1 and utility stitch count Na2. Such configuration allows cumulative values to be stored depending on the usage of sewing machine M, thereby enabling communication of maintenance information depending on the usage of sewing machine M.

Timing of communicating the maintenance information is set at multiple timings corresponding to the cumulative values of sew time Ta, stitch count Na, Na1, and Na2. The content of maintenance information to be communicated is determined depending on the applicable alert timing among the multiple alert timings to allow communication of appropriate maintenance information suitable for the cumulative value reached.

As can be seen in FIGS. 7, 8, and 9, the maintenance information is represented in various formats such as graphic, character, and numeral to facilitate user visual recognition of the maintenance information.

Next, a description will be given on partial modifications of the above described exemplary embodiments.

In a first modified exemplary embodiment, controller C configured to store cumulative values of both sew time and stitch count may be arranged to store either of the cumulative values. Alternatively, controller C may be arranged to store only the total stitch count for stitch count.

In a second exemplary embodiment, maintenance information displayed on LCD 6 as exemplified in FIGS. 7, 8, and 9 may also employ other types of maintenance information. Further, sewing machine M may provide the maintenance information through user interface other than LCD 6. One exemplary alternative may be audio information, in which case a speaker is provided to alert the user by voice messages or a buzzer. Yet, another alternative may be a provision of a warning lamp which is illuminated continuously or intermittently to drawn the user's attention.

In a third exemplary embodiment, the maintenance information displayed at certain exemplary sew time, embroidery stitch count, utility stitch count, and total stitch count in the earlier exemplary embodiment may be modified as required. The count of display of the maintenance information is not limited to once every time power is turned on, amounting to a total of 3 times. Alternatively, the maintenance information may be displayed for example, for a total of 3 times when sew time Ta has reached 500 hours, and may be gradually increased with time as 600, 700, 800, and 900 hours elapse. After sew time Ta reaches 1000 hours, the maintenance information may be displayed every time power of sewing machine M is turned on to draw extra attention. Further, the user may be allowed to edit these settings as required.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a maintenance information storage that stores maintenance information;

an alert element that communicates the maintenance information;

a cumulative data storage that stores cumulative data of at least either of a sew time or a stitch count;

a determiner that determines whether or not a predetermined timing for communicating the maintenance information has been reached based on the cumulative data;

an alert count storage that stores an alert count of the maintenance information communicated; and an alert controller that, when determined by the determiner to have reached the predetermined timing for communicating the maintenance information, controls the alert element to communicate the maintenance information for a predetermined number of times based on the alert count.

2. The sewing machine according to claim 1, wherein the cumulative data comprises a first cumulative data and a second cumulative data and wherein the second cumulative data represents cumulative status when power of the sewing machine is turned off.

3. The sewing machine according to claim 2, wherein the first cumulative data is updated whenever power of the sewing machine is turned on and the second cumulative data is updated whenever power of the sewing machine is turned off.

4. The sewing machine according to claim 1, wherein the cumulative data of the stitch count comprises cumulative data of stitch count consumed in sewing embroidery patterns and cumulative data of stitch count consumed in sewing utility patterns.

5. The sewing machine according to claim 1, wherein the predetermined timing for communicating the maintenance information is set in a plurality timings associated with the cumulative data and wherein the maintenance information to be communicated is specified depending on the timing determined to have been reached by the determiner among the plurality of timings.

6. The sewing machine according to claim 1, wherein the alert element comprises a user interface including a display capable of displaying graphic, character and numeric information.

7. A computer readable medium storing a maintenance information communicating program for use in a sewing machine including a maintenance information storage that stores maintenance information, an alert element that communicates the maintenance information, a cumulative data storage that stores cumulative data of at least either of a sew time or a stitch count, an alert count storage that stores an alert count of the maintenance information communicated, the computer readable medium storing the maintenance information alert program, comprising:

instructions for storing the cumulative data to the cumulative data storage;

instructions for determining whether or not a predetermined timing for communicating the maintenance information has been reached based on the cumulative data;

instructions for storing the alert count of the maintenance information communicated to the alert count storage; and instructions for communicating the maintenance information for a predetermined number of times based on the alert count when determined to have reached the predetermined timing for communicating the maintenance information.

8. The computer readable medium storing the maintenance information alert program according to claim 7, wherein the maintenance information alert program further comprises instructions for configuring the cumulative data into a first cumulative data and a second cumulative data representing cumulative status when power of the sewing machine is turned off.

9. The computer readable medium storing the maintenance information alert program according to claim 8, wherein the maintenance information alert program further comprises instructions for updating the first cumulative data when power of the sewing machine is turned on and instructions for updating the second cumulative data when power of sewing machine is turned off.

10. The computer readable medium storing the maintenance information alert program according to claim 7, wherein the maintenance information alert program further comprises instructions for configuring the cumulative data of the stitch count into cumulative data for storing stitch count consumed in sewing embroidery patterns and cumulative data for storing stitch count consumed in sewing utility patterns.

11. The computer readable medium storing the maintenance information alert program according to claim 7, wherein the timing for communicating the maintenance information is set in a plurality of timings associated with the cumulative data, the maintenance information alert program further comprising instructions for specifying the maintenance information to be communicated depending on the timing determined to have been reached among the plurality of timings.

12. The computer readable medium storing the maintenance information alert program according to claim 7, wherein the alert element comprises a user interface including a display and wherein the maintenance information alert program further comprises instructions for communicating graphic, character and numeric information through the user interface.

* * * * *